United States Patent [19]

Bozzelli et al.

[11] 4,001,107

[45] Jan. 4, 1977

[54] MORPHOLINONES AS SELECTIVE SOLVENTS FOR AROMATIC HYDROCARBONS

[75] Inventors: John W. Bozzelli; George D. Shier, both of Midland, Mich.

[73] Assignee: The Dow Chemical Company, Midland, Mich.

[22] Filed: June 18, 1975

[21] Appl. No.: 588,128

[52] U.S. Cl. ..... 208/323; 208/326; 260/674 SE

[51] Int. Cl.[2] ..... C10G 21/16

[58] Field of Search ..... 208/326, 323; 260/674 SE

[56] References Cited

UNITED STATES PATENTS

| | | | |
|---|---|---|---|
| 2,357,667 | 9/1944 | Kuhn | 208/326 |
| 3,120,487 | 2/1964 | Norton et al. | 208/326 |
| 3,755,154 | 8/1973 | Akabayashi et al. | 208/326 |

*Primary Examiner*—Herbert Levine

*Attorney, Agent, or Firm*—G. R. Plotecher; C. E. Rehberg

[57] ABSTRACT

Morpholinones are efficient selective solvents for aromatic hydrocarbons from hydrocarbon mixtures containing same. For example, N-methyl-3-morpholinone is an efficient selective solvent for benzene, toluene, and xylene from a hydrocarbon stream obtained from a catalytic reformer.

8 Claims, No Drawings

MORPHOLINONES AS SELECTIVE SOLVENTS FOR AROMATIC HYDROCARBONS

BACKGROUND OF THE INVENTION

1. Field of the Invention

This invention relates to a process for the recovery of aromatic hydrocarbons from hydrocarbon mixtures containing same. More specifically, this invention relates to an improved process for the recovery of aromatic hydrocarbons from hydrocarbon mixtures containing same wherein a morpholinone is used as the selective solvent.

2. Description of the Prior Art

The known solvents for the extraction of aromatic hydrocarbons from hydrocarbon mixtures containing same are varied and many. For example, these solvents include morpholine (U.S. Pat. No. 2,251,773), aldehydo- and keto-morpholines (U.S. Pat. No. 2,357,667), pyrrolidone (U.S. Pat. No. 2,943,122 and 3,082,271), sulfolane (U.S. Pat. No. 3,222,416), and tetraethylene glycol (U.S. Pat. No. 2,302,383). This type of solvent is generally employed in a liquid-liquid extraction system which may be followed by fractional distillation. This system is outlined in U.S. Pat. No. 3,816,302 which is herein incorporated by reference.

The morpholinones here used are known in the prior art. They can be prepared by either reacting 2-p-dioxanone and a primary amine (U.S. Pat. No. 3,092,630) or by dehydrogenation of N-substituted dialkanolamines (U.S. Pat. No. 3,073,822).

SUMMARY OF THE INVENTION

According to this invention, the process for recovering aromatic hydrocarbons from a hydrocarbon mixture containing both aromatic and nonaromatic hydrocarbons by liquid-liquid extraction using a selective solvent is improved by using a morpholinone free of substituents other than lower alkyl groups with a total alkyl carbon content of not more than about 12 carbon atoms as the selective solvent. The selective solvent can be comprised solely of a morpholinone or of a mixture of a morpholinone and any suitable additive, such as water and/or glycol.

DETAILED DESCRIPTION OF THE INVENTION

The morpholinones here used are morpholinones free of substituents other than lower alkyl groups, i.e. alkyl groups of from 1 to 4 carbon atoms each, with a total alkyl carbon content of not more than about 12 carbon atoms. By way of illustration, such morpholinones include 2-morpholinone, 3-morpholinone, N-methyl-3-morpholinone, N-butyl-2-morpholinone, N-butyl-3-morpholinone, N-methyl-5-ethyl-3-morpholinone, 2,5-dibutyl-3-morpholinone, N-methyl-2,5,6-triethyl-3-morpholinone, and the like. Morpholinones wherein the lower alkyl group attached to the nitrogen atom is methyl are preferred, as are morpholinones free of substituents other than a lower alkyl group attached to the nitrogen atom. N-methyl-3-morpholinone is especially preferred.

The selective solvent here used may consist of either a morpholinone by itself or a morpholinone in combination with a suitable additive or additives, such as a glycol, water, or both. Such additives will increase the morpholinone's selectivity for aromatic hydrocarbons but they may also decrease its capacity for same. Consequently, the practitioner's particular choice of morpholinone to additive ratio will be governed by his desired balance between selectivity and capacity. Generally, a morpholinone will comprise at least about 50 weight percent of such a selective solvent mixture, with typcial mixtures consisting of a. from about 50 to about 99 weight percent morpholinone,
b. from 0 to about 50 weight percent water, and
c. from 0 to about 50 weight percent glycol.

Mixtures of a. from about 50 to about 95 weight percent morpholinone,
b. from 0 to about 20 weight percent water, and
c. from about 5 to about 30 weight percent glycol are preferred because of the relatively good balance between selectivity and capacity.

The glycol here used is of the formula

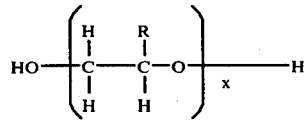

wherein R is hydrogen or methyl and $x$ is an integer from 1 to 5. Ethylene glycol is preferred due to its established familiarity.

The hydrocarbon mixtures upon which the solvent can be employed may be comprised of any liquid hydrocarbons wherein at least 2 percent by weight are aromatic hydrocarbons. The feed streams obtained from catalytic reformers are typical of the hydrocarbon mixtures here used. Said streams are usually comprised of paraffins and aromatics, the latter essentially comprised of benzene, toluene, and xylene. The aromatic content of the hydrocarbon mixture should generally not exceed about 90 weight percent of the total mixture because above about 90 weight percent the solvent and hydrocarbon mixture become miscible. Best results are obtained where the invention is practiced upon a hydrocarbon mixture comprised of between about 5 weight percent and about 80 weight percent aromatic hydrocarbons.

Morpholinones exhibit exceptional qualities that allow their use as selective solvents under a wide variety of conditions. Of course, the specific extraction parameters of any given system will depend upon any number of variables, such as the desired balance between selectivity and capacity, the additive, if any, the hydrocarbon mixture, contact time, etc. By way of illustration, morpholinones are operative as selective solvents between about 10° C and about 180° C, although temperatures between about 25° C and about 150° C are preferred. Likewise, the invention can be practiced at either reduced or increased pressure. Operative pressures range from about 6 psi to about 1,000 psi although preference is had for a pressure of one atmosphere because of convenience. Contact time between solvent and hydrocarbon mixture may be as brief as one-half minute with no theoretical upper limit although considerations of convenience, economics, and practicality suggest a maximum of about 3 hours.

After an aromatic fraction has been extracted from a hydrocarbon mixture and dissolved into the solvent, it is of course necessary to separate the aromatics from the solvent. Here too morpholinones exhibit advantageous qualities. For example, N-methyl-3-morpholinone has a boiling point of 225° C. Where a selective solvent is used to extract the aromatic fraction (comprising essentially benzene, toluene, and xylene) from a feed stream obtained from a catalytic reformer, it is desirable to have a selective solvent with a boiling point at least 40° C above that of xylene (approximately 140° C), i.e. 180° C.

Morpholinones also exhibit other advantageous qualities that make them desirable selective solvents for aromatic hydrocarbons. By way of illustration, N-methyl-3-morpholinone has a great affinity for water, thus enabling a simple wash step to recover traces of same from the extract and raffinate phases. This in turn means minimum solvent loss and low solvent makeup. N-methyl-3-morpholinone is also noncorrosive, partly attributable to its excellent chemical and thermal stability. Moreover, toxicological data show N-methyl-3-morpholinone to be a low health hazard ($LD_{50}$>2 g/kg).

The following Example is illustrative of certain specific embodiments of this invention. However, this Example is for illustrative purposes only and should not be construed as a limitation upon the invention.

EXAMPLE

Capacity and selectivity are common standards by which selective solvents are assessed for operability and utility in a liquid-liquid extraction system (Muller E., Hoehfeld, G., "Aromatics Extraction with Solvent Combinations;" 7th World Petro Congress., Mexico City; P.O. No. 16(2); Apr. 2, 1967). Capacity is the dominant factor because it determines the circulation rate of the solvent and consequently, the size of most of the plant equipment. As such, the data in Tables I and II were generated to demonstrate the operability and utility of a morpholinone, N-methyl-3-morpholinone, as a selective solvent for aromatic hydrocarbons. Tetraethylene glycol, a known and used selective solvent for aromatic hydrocarbons, was used as a basis for comparison.

The data were generated according to the following procedure:

a. One ml of hydrocarbon feed (heptane-benzene and/or toluene and/or p-xylene) was pipetted into a glass vial followed by 3 ml of solvent (N-methyl-3-morpholinone or tetraethylene glycol).

b. The resulting two-layer mixture was shaken for 20 min (optimum contact time assumed) at room temperature.

c. The vial was removed from the shaker and the phases were allowed to separate (approximately 60 sec for the vials containing N-methyl-3-morpholinone and approximately 60 to 180 sec for the vials containing tetraethylene glycol).

d. Each phase was then analyzed using a Hewlett Packard 5710A gas chromatograph fitted with an 18 in. × ⅛ in. stainless steel column packed with Porapak R with a helium flow rate of approximately 30 ml/min. Peak integration was done by a GLC-8 computer utilizing an internal standard. A 1 $\mu$l sample was used and weight percent errors were found to be ±3 percent.

Capacity and selectivity are defined as follows:

a) Capacity ≡ distribution coefficient ($DC$).

b) $$DC = \frac{\text{Concentration in solvent phase}}{\text{Concentration in raffinate phase}}$$

c) $$\text{Selectivity} = \frac{DC \text{ for aromatics}}{DC \text{ for nonaromatics}}$$

The data of Tables I and II clearly show that N-methyl-3-morpholinone is a highly efficient, selective solvent for aromatic hydrocarbons.

TABLE I

CAPACITIES AND SELECTIVITIES FOR TETRAETHYLENE GLYCOL AND N-METHYL-3-MORPHOLINONE WITH 25% AROMATICS IN FEED (BY VOLUME) AT 25° C

| SOLVENT: FEED | | BENZENE | | TOLUENE | | p-XYLENE | |
|---|---|---|---|---|---|---|---|
| (VOL RATIO) | % WT $H_2O$ | CAPACITY | SELECTIVITY | CAPACITY | SELECTIVITY | CAPACITY | SELECTIVITY |
| TETRA | 0 | 0.338 | 23.9 | 0.225 | 15.9 | 0.129 | 9.1 |
| (3:1) | 5 | 0.257 | 27.8 | 0.160 | 19.0 | 0.082 | 11.0 |
| NMM | 0 | 0.726 | 21.6 | 0.736 | 18.2 | 0.359 | 13.4 |
| (3:1) | 5 | 0.553 | 32.4 | 0.498 | 26.5 | 0.223 | 18.0 |

TABLE II

CAPACITIES AND SELECTIVITIES FOR TETRAETHYLENE GLYCOL AND N-METHYL-3-MORPHOLINONE WITH 50% AROMATICS IN FEED (BY VOLUME) AT 25° C

| SOLVENT: FEED | | BENZENE | | TOLUENE | | p-XYLENE | |
|---|---|---|---|---|---|---|---|
| (VOL RATIO) | % WT $H_2O$ | CAPACITY | SELECTIVITY | CAPACITY | SELECTIVITY | CAPACITY | SELECTIVITY |
| TETRA | 0 | 0.350 | 18.1 | 0.230 | 10.4 | 0.135 | 7.4 |
| (3:1) | 5 | 0.258 | 21.2 | 0.161 | 13.5 | 0.097 | 8.14 |
| NMM | 0 | 0.766 | 16.5 | 0.714 | 12.7 | 0.402 | 8.5 |
| (3:1) | 5 | 0.566 | 23.0 | 0.465 | 16.2 | 0.251 | 11.4 |

What is claimed is:

1. In a process for recovering aromatic hydrocarbons from a hydrocarbon mixture containing both aromatic and nonaromatic hydrocarbons by liquid-liquid extraction using a selective solvent, the improvement wherein the selective solvent comprises a morpholinone free of substituents other than lower alkyl groups with a total alkyl carbon content of not more than about 12 carbon atoms.

2. The process of claim 1 wherein the lower alkyl group attached to the morpholinone at the nitrogen atom is methyl.

3. The process of claim 1 wherein the morpholinone is free of substituents other than a lower alkyl group attached to the nitrogen atom.

4. The process of claim 1 wherein the morpholinone is N-methyl-3-morpholinone.

5. The process of claim 1 wherein the selective solvent consists essentially of at least about 50 weight percent of the morpholinone and the remainder is water, a glycol of the formula

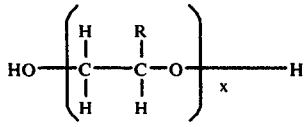

wherein R is hydrogen or methyl and $x$ is an integer from 1 to 5, or a mixture thereof.

6. The process of claim 5 wherein the selective solvent is a mixture consisting essentially of:

a. from about 50 to about 99 weight percent of the morpholinone, b. from 0 to about 50 weight percent water, and c. from 0 to about 50 weight percent of the glycol.

7. The process of claim 5 wherein the selective solvent is a mixture consisting essentially of:

a. from about 50 to about 95 weight percent of the morpholinone, b. from 0 to about 20 weight percent water, and c. from 5 to about 30 weight percent of the glycol.

8. The process of claim 6 wherein the glycol is ethylene glycol.

* * * * *